US006836623B2

(12) United States Patent
Imai

(10) Patent No.: US 6,836,623 B2
(45) Date of Patent: Dec. 28, 2004

(54) IMAGING APPARATUS AND REMOTE MANAGEMENT SYSTEM OF THE SAME

(75) Inventor: Tatsuya Imai, Tokyo (JP)

(73) Assignee: Ricoh Company, Ltd. (JP)

( * ) Notice: Subject to any disclaimer, the term of this patent is extended or adjusted under 35 U.S.C. 154(b) by 33 days.

(21) Appl. No.: 10/392,861

(22) Filed: Mar. 21, 2003

(65) Prior Publication Data

US 2003/0223766 A1 Dec. 4, 2003

(30) Foreign Application Priority Data

Mar. 25, 2002 (JP) ..... 2002-083329
Mar. 12, 2003 (JP) ..... 2003-067159

(51) Int. Cl.[7] ..... G03G 15/00
(52) U.S. Cl. ..... 399/8; 399/14
(58) Field of Search ..... 399/8, 11, 9, 14

(56) References Cited

U.S. PATENT DOCUMENTS 5,282,127 A * 1/1994 Mii ..... 399/8
5,343,276 A * 8/1994 Yamashita et al. ..... 399/8
5,442,541 A * 8/1995 Hube et al.
5,594,529 A * 1/1997 Yamashita et al. ..... 399/8
5,933,675 A * 8/1999 Sawada et al. ..... 399/8
6,032,001 A * 2/2000 Miyawaki ..... 399/8
6,311,024 B1 * 10/2001 Serizawa et al. ..... 399/8

FOREIGN PATENT DOCUMENTS

JP 02165983 A * 6/1990 ..... B41J/29/20

* cited by examiner

*Primary Examiner*—Susan Lee
(74) *Attorney, Agent, or Firm*—Dickstein Shapiro Morin & Oshinsky LLP

(57) ABSTRACT

In a multi-function imaging machine, a termination condition for each application is managed at a remote location, and a termination operation of the application based on the termination condition is controlled at the imaging apparatus. This imaging apparatus implements a plurality of different applications related to imaging and includes a communication unit that enables transmission and reception of information between an external apparatus, a table that records an application usage state and a termination condition set by the external apparatus for each application, and a control unit that determines whether or not any of the applications satisfies the termination condition during activation by referring to the table, and terminates the application when the termination condition is satisfied.

22 Claims, 15 Drawing Sheets

FIG.4

APPLICATION USAGE MANAGEMENT TABLE

| APPLICATION IDENTIFIER | VERSION | STATE | ACTIVATION COUNT | NUMBER OF JOBS | NUMBER OF PAGES | TERMINATION CONDITION | ACTIVATION COMMAND | INITIAL STATE |
|---|---|---|---|---|---|---|---|---|
| COPIER | 1.34 | ACTIVATED | 4 | 13 | 45 | NUMBER OF JOBS > 34 | exec/bin/copyap1 | ACTIVATE |
| PRINTER | 1.34 | TERMINATED | 26 | 127 | 130 | NUMBER OF PAGES > 130 | exec/bin/copyap1 | ACTIVATE |
| SCANNER | 1.02 | ACTIVATED | 4 | 5 | 5 | ACTIVATION COUNT > 20 | exec/bin/scannaap1 | TERMINATE |
| FAX | – | – | 6 | 108 | 80 | DATE > DEC. 17 | – | – |
| . . . | . . . | . . . | . . . | . . . | . . . | . . . | . . . | . . . |
| . . . | . . . | . . . | . . . | . . . | . . . | . . . | . . . | . . . |

FIG.7A

```
POST / applicationManager HTTP/1.1
Host: www.example.ricoh.co.jp
Content-Type: application/soap; charset="utf-8"
Cntent-Length: nnnn
SOAPAction: "http://example.ricoh.co.jp/2002/12/modifyTable"

<?xml version="1.0"?>
<env:Envelope xmlns:env="http://www.w3.org/2001/12/soap-envelope">
 <env:Body>
  <m:stateChanged
        env:encodingStyle="http://www.w3.org/2001/12/soap-encoding"
        xmlns:m="http://example.ricoh.co.jp/2002/12">
    <AplID>scanner</AplID>
    <newState> activate </newState>
  </stateChanged>
 </env:Body>
</env:Envelope>
```

FIG.7B

```
POST /applicationManager HTTP/1.1
Host: www.example.ricoh.co.jp
Content-Type: application/soap; charset="utf-8"
Cntent-Length: nnnn
SOAPAction: "http://example.ricoh.co.jp/2002/12/modifyTable"

<?xml version="1.0"?>
<env:Envelope xmlns:env="http://www.w3.org/2001/12/soap-envelope">
 <env:Body>
  <m:stateChanged
        env:encodingStyle="http://www.w3.org/2001/12/soap-encoding"
        xmlns:m="http://example.ricoh.co.jp/2002/12">
    <AplID>scanner</AplID>
    <newState> terminate </newState>
  </stateChanged>
 </env:Body>
</env:Envelope>
```

FIG.9

```
POST /applicationManager HTTP/1.1
Host: www.example.ricoh.co.jp
Content-Type: application/soap; charset="utf-8"
Cntent-Length: nnnn
SOAPAction: "http://example.ricoh.co.jp/2002/12/modifyTable"

<?xml version="1.0"?>
<env:Envelope xmlns:env="http://www.w3.org/2001/12/soap-envelope">
 <env:Body>
  <m:modifyTable
        env:encodingStyle="http://www.w3.org/2001/12/soap-encoding"
        xmlns:m="http://example.ricoh.co.jp/2002/12">
    <targetTable>application management table </targetTable>
    <targetItem>scanner</targetItem>
    <targetValue>
          <field>termination condition </field>
          <newValue>number of pages 150 </newValue>
    </targetValue>
  </m:modifyTable>
 </env:Body>
</env:Envelope>
```

FIG.11

62

| IMAGING APPARATUS IDENTIFIER | APPLICATION IDENTIFIER | INITIAL SETTING | TERMINATION CONDITION |
|---|---|---|---|
| 11011 | COPIER | ACTIVATE | ○○MIN. |
| | PRINTER | ACTIVATE | ××MIN. |
| | SCANNER | ACTIVATE | □□MIN. |
| | FAX | TERMINATE | |
| 11012 | COPIER | ACTIVATE | ○○MIN. |
| | PRINTER | TERMINATE | |
| | SCANNER | TERMINATE | |
| | FAX | ACTIVATE | □□MIN. |
| 11013 | COPIER | ACTIVATE | ○○MIN. |
| | PRINTER | ACTIVATE | ××MIN. |
| | SCANNER | ACTIVATE | ... |
| | FAX | ... | ... |
| | ... | ... | ... |
| ... | | | |

FIG.14A

```
POST /applicationManager HTTP/1.1
Host: www.example.ricoh.co.jp
Content-Type: application/soap; charset="utf-8"
Cntent-Length: nnnn
SOAPAction: "http://example.ricoh.co.jp/2002/12/modifyTable"

<?xml version="1.0"?>
<env:Envelope xmlns:env="http://www.w3.org/2001/12/soap-envelope">
 <env:Body>
  <m:changeState
        env:encodingStyle="http://www.w3.org/2001/12/soap-encoding"
        xmlns:m="http://example.ricoh.co.jp/2002/12">
    <AplID>scanner</AplID>
    <newState> activate </newState>
  </changeState>
 </env:Body>
</env:Envelope>
```

FIG.14B

```
POST /applicationManager HTTP/1.1
Host: www.example.ricoh.co.jp
Content-Type: application/soap; charset="utf-8"
Cntent-Length: nnnn
SOAPAction: "http://example.ricoh.co.jp/2002/12/modifyTable"

<?xml version="1.0"?>
<env:Envelope xmlns:env="http://www.w3.org/2001/12/soap-envelope">
 <env:Body>
  <m:changeState
        env:encodingStyle="http://www.w3.org/2001/12/soap-encoding"
        xmlns:m="http://example.ricoh.co.jp/2002/12">
    <AplID>scanner</AplID>
    <newState> terminate </newState>
  </changeState>
 </env:Body>
</env:Envelope>
```

IMAGING APPARATUS AND REMOTE MANAGEMENT SYSTEM OF THE SAME

BACKGROUND OF THE INVENTION

1. Field of the Invention

The present invention relates generally to a multi-function imaging apparatus that has one or more imaging functions and to a remote management system for this imaging apparatus. More particularly, the present invention relates to a multi-function imaging apparatus that is capable of managing the activation conditions and termination conditions of each application set up by a remote management apparatus and of accurately controlling the termination of each application.

2. Description of the Related Art

A so-called multi-function imaging machine, which is an all-in-one imaging apparatus that offers a variety of imaging services such as printing, copying, facsimile, and scanning to a user, has application programs corresponding to each of the offered functions. In the multi-function imaging machine, an algorithm in common with all the application programs is inserted between the application programs and hardware resources. Such an algorithm is implemented as an OS (operating system) or a common system service. By allowing the application programs to co-use the algorithm, the development efficiency of the applications can be improved.

The multi-function imaging apparatus can be stationed at various locations, such as an office, a library, a convenience store, a medical institution, or an academic institution, and is used for photocopying, sending and receiving facsimile, printing output data, etc.

In the above imaging apparatus, a charging service may be provided for the use of the imaging services. If the imaging apparatus is for individual use, the user will usually have to insert a coin or a pre-paid card. On the other hand, the multi-function imaging apparatus may be used under a contract that sets forth specific usage conditions. The usage conditions may be, for example, 300 pages per day for the printer service, 30 copy jobs per day for the copier service, etc. Other usage conditions such as available time, the number of times an application is activated, or the total number of pages can also be conceived. These usage conditions do not necessarily have to be fixed. Also, there is a need for the imaging apparatus to properly terminate a particular application program if this application program no longer satisfies the prescribed usage conditions.

Under such circumstances, a system that is capable of comprehensively grasping the usage conditions of each of the applications installed in the multi-function imaging apparatus stationed at various locations, and controlling the activation conditions and the termination conditions of the application programs at a remote area is desired.

One known technique for controlling the activation of a program at a remote area is MMC (Microsoft Management Console) for Windows NT and subsequent versions provided by Microsoft Co., Ltd. This management console controls the activation and termination of application services at a remote computer.

Also, a feature of UNIX (registered trademark), allows remote log-in to activate and terminate an application installed in a remote computer.

However, the above described techniques only allow activation and termination of an application via a communication network, and the terminal apparatus itself cannot automatically terminate an application when the predetermined condition is no longer satisfied. Also, neither of the above technologies is capable of activating or terminating a program when the network connection is cut off.

On the other hand, technologies for automatically terminating a program can be found in shareware, or free (public domain) software. In such free software or shareware, a program is arranged to be prevented from starting up after a predetermined testing period has expired. The application itself determines whether or not the testing period has expired every time the application is activated. If it is determined upon its activation that the testing period has expired, the application will not start thereafter. The terminal apparatus in which the above application is installed has nothing to do with the control of the activation ban of this application.

In the above technology, the determination of whether or not the testing period has expired is performed only at the time the application is activated. Thus, once the application is activated, the application cannot be automatically terminated in response to a predetermined condition as a trigger.

SUMMARY OF THE INVENTION

Accordingly, it is an object of the present invention to provide a configuration in which conditions for activating and terminating each application, set externally beforehand, can be managed internally by an imaging apparatus, and the application that ceases to satisfy the prescribed conditions during activation can be terminated at the imaging apparatus.

It is another object of the present invention to provide a remote management system that is capable of setting and changing the conditions for the imaging apparatus at a remote location and managing the usage conditions of the imaging apparatus.

To realize the above objects of the present invention, the imaging apparatus takes in the termination conditions set and managed at the remote management apparatus, and terminates a particular application that satisfies its termination condition during activation.

Each of the applications installed in the imaging apparatus may also be activated or terminated by the remote management apparatus.

Also, the termination condition can be changed at the remote management apparatus, wherein the imaging apparatus takes in the changed termination condition and terminates an application accordingly.

Specifically, according to a first aspect of the present invention, an imaging apparatus that implements a plurality of different applications related to imaging is provided. This imaging apparatus includes:

a communication unit that transmits and receives information to and from an external apparatus;

a table that records an application usage state and a termination condition set by the external apparatus for each of the applications; and a control unit that determines whether or not any of the applications satisfies the termination condition during activation by referring to the table, and terminates the application that satisfies the termination condition.

In this imaging apparatus, the termination operation for an application can be controlled within the imaging apparatus based on the termination condition set by the external apparatus. Thereby, an application can be properly terminated upon fulfillment of a particular termination condition even when there is a problem in the network connecting the imaging apparatus and the external apparatus.

The communication unit receives first update information for changing the termination condition from the external apparatus and the control unit updates the table based on the first update information.

In this way, the imaging apparatus can easily adjust to changes made in the termination condition and can terminate an application based on the updated termination condition.

The table also records an initial state indicating whether or not each application is to be activated upon power-on of the imaging apparatus, and the control unit activates the applications that need to be activated by referring to the table.

In this way, an application that is rarely used can be prevented from taking up memory resources in the imaging apparatus and user-friendliness of the imaging apparatus can be enhanced.

The communication unit receives second update information for changing an initial state of an application from the external apparatus and the control unit updates the table based on the second update information.

In this way, the imaging apparatus can take in the most recent update to the initial state so that unnecessary applications can be prevented from being activated and the usage efficiency of the memory can be improved.

The control unit includes a system control part that provides an algorithm that is common to the plurality of different applications installed in the imaging apparatus, and an application control part that is inserted between the system control part and the applications. The application control part terminates the corresponding application via the system control part when the termination condition is satisfied.

In this, way, the development of system resources can be accomplished efficiently.

According to a second aspect of the present invention, a remote management system that includes an imaging apparatus implementing a plurality of different applications related to imaging, and a remote management apparatus, connected to the imaging apparatus via a network, that manages an operation condition of the imaging apparatus is provided. The remote management apparatus sets a termination condition for terminating each application of the imaging apparatus and sends the set termination condition to the imaging apparatus via the network. The imaging apparatus stores the termination condition received from the remote management apparatus in a storage area in association with the corresponding application, and terminates the application that satisfies the termination condition during activation.

According to this system, the termination condition of the imaging apparatus is managed at the remote management apparatus, but the actual termination of the application is independently controlled at the imaging apparatus.

The imaging apparatus notifies the remote management apparatus of the termination of an application when it terminates the application.

In this way, the remote management apparatus is able to verify that the application satisfying the termination condition has been properly terminated.

The remote management apparatus has an expiration time management unit that manages an expiration time for each application in the imaging apparatus, generates a termination instruction command for the application that has reached the expiration time, and sends the termination instruction command to the imaging apparatus. The imaging apparatus terminates the application based on the termination instruction command received from the remote management apparatus.

In this way, an expiration time based on a particular contract period and the like is managed at the remote management apparatus, and the imaging apparatus is controlled to properly terminate a particular application when the valid term expires.

Also, the remote management apparatus generates an activation instruction command for activating a particular application upon power-on of the imaging apparatus, and sends this to the imaging apparatus. The imaging apparatus activates the corresponding application based on the activation instruction command received from the remote management apparatus.

In this way, it is possible to control the activation of a particular application of the imaging apparatus at the remote management apparatus.

BRIEF DESCRIPTION OF THE DRAWINGS

FIG. 4 shows a data structure of the application usage management table used in the imaging apparatus;

FIGS. 7A and 7B show communication data of SOAP messages as examples of state notifications sent from the imaging apparatus to the remote management apparatus, wherein FIG. 7A shows a notification of the activation of a scanner application, and FIG. 7B shows a notification of the termination of the scanner application in response to its termination condition being satisfied;

FIG. 9 shows an example of communication data of a SOAP message notification of the updating of a condition of the scanner application;

FIG. 11 shows a data structure of a usage mode management table stored in the remote management apparatus according to the second embodiment of the present invention;

FIGS. 14A and 14B show examples of communication data of a SOAP message, wherein FIG. 14A represents an activation instruction, and FIG. 14B represents a termination instruction.

DESCRIPTION OF THE PREFERRED EMBODIMENTS

In the following, preferred embodiments of the present invention are described with reference to the accompanying drawings.

Figure 1:
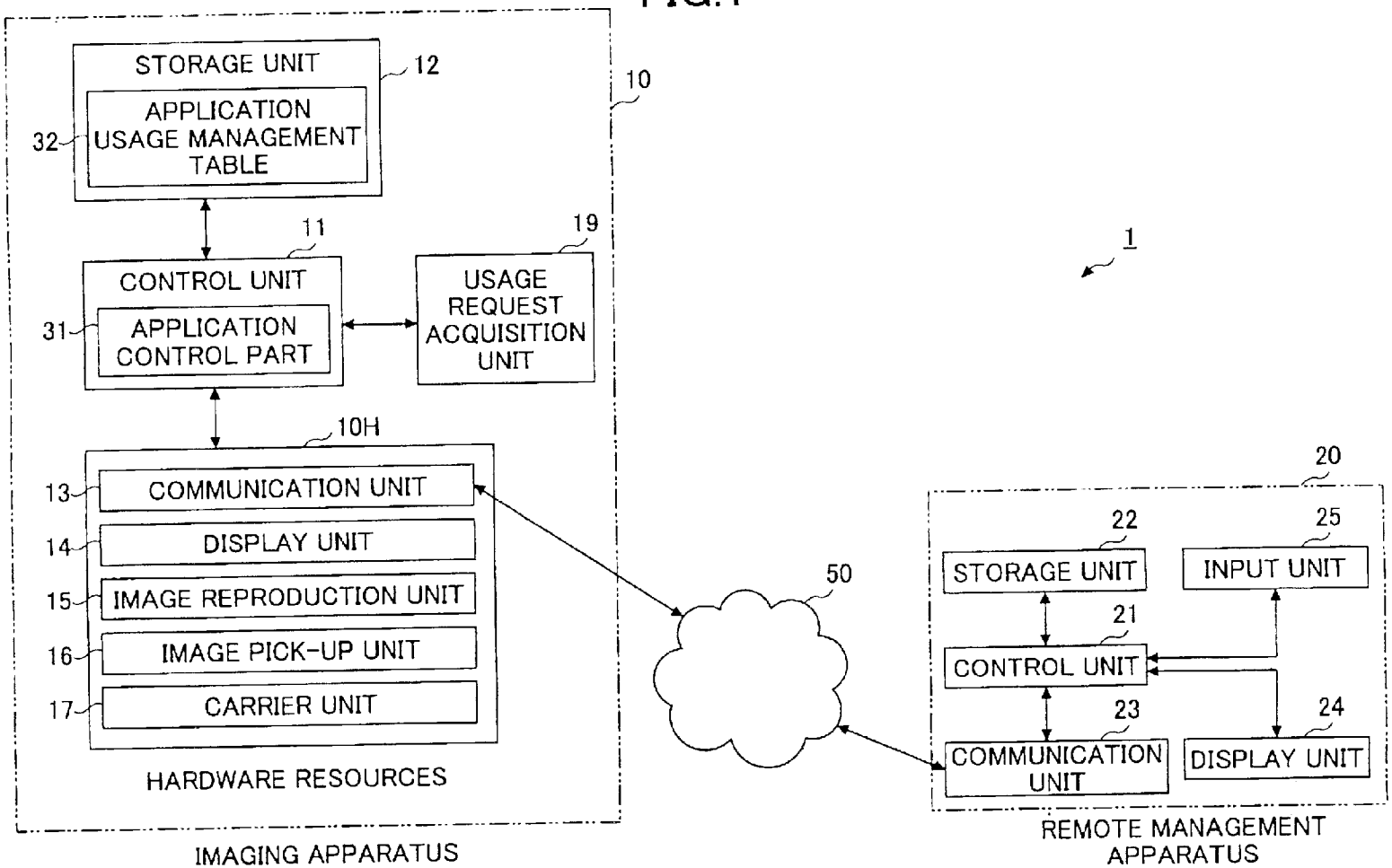
FIG. 1 shows an overall configuration of a remote management system according to a first embodiment of the present invention.

FIG. 1 shows a configuration of a remote management system according to a first embodiment of the present invention. The remote management system 1 includes an imaging apparatus 10 and a remote management apparatus 20 that manages the imaging apparatus 10 from a remote location. The imaging apparatus 10 and the remote management apparatus 20 are connected via the Internet 50, and a connection according to the HTTP (hyper text transfer protocol), for example, is established. It should be noted that in this drawing, only one imaging apparatus 10 is shown in order to simplify the following descriptions; however, the system of the present embodiment is configured to include a plurality of imaging apparatuses 10 under the management of one remote management apparatus 20.

The imaging apparatus 10 is a multi-function imaging apparatus that is provided with a variety of applications related to imaging and includes hardware resources 10H, a control unit 11, a storage unit 12, and a usage request acquisition unit 19. The hardware resources 10H include a communication unit 13, a display unit 14, an image reproduction unit 15, an image pick-up unit 16, and a carrier unit 17. These hardware resources provide various user services according to predetermined control processes (jobs) Specifically, the communication unit 13 is a communication interface that sends/receives information to/from the remote management apparatus 20 via the Internet 50. The display unit 14 may be a LCD (liquid crystal display), or some other type of display panel. The image reproduction unit 15 may be a printing device, for example, and includes a sensor that counts the number of output pages. The image pick-up unit 16 may be a scanner, or some other type of optical reading device. The carrier unit 17 controls the operation of a drum or a roller upon performing a user service such as copying or printing and carries the recording medium.

The control unit 11 is realized by a CPU, for example, and includes an application control part 31. The application control part 31 acquires the usage conditions of each activating application in the imaging apparatus 10, compares the acquired usage conditions to the pre-established conditions, and controls the termination of the applications.

The storage unit 12 includes a memory, a register, and a hard disk. In the hard disk of the storage unit 12, application programs that provide each of a printer service, a copier service, a facsimile service, and a scanner service are stored. Also, control service programs and application control programs that provide common functions for all of the above application programs are stored in this hard disk. Each of the application programs, the control service programs, and the application control programs is loaded and executed by means of the control unit 11 and the storage unit 12.

The storage unit 12 also stores an application usage management table 32 that records an identifier, a usage state, a termination condition, and the like for each application. The above application control part 31 writes the acquired current usage conditions into the application usage management table 32 and also determines the termination operation of each application by referring to the termination condition recorded in the application usage management table 32.

The usage request acquisition unit 19 is a touch panel, for example, and accepts various inputs such as a usage request for a service made by a user.

On the other hand, the remote management apparatus 20 includes a control unit 21, a storage unit 22, a communication unit 23, a display unit 24, and an input unit 25.

The control unit 21 includes a CPU, for example, and generates various commands that include conditions for the activation and termination of each application in the imaging apparatus 10 based on information received from the imaging apparatus 10 via the communication unit 23 or information input by an operator via the input unit 25.

The storage unit 22 includes a memory, a register and a hard disk. The communication unit 23 is a communication interface, for example. The display unit 24 is a computer display, for example. The input unit 25 may be a key board and a pointing device, for example. The setting, changing or updating of the termination conditions for each imaging apparatus is input to the control unit 21 by the input unit 25.

Figure 2:
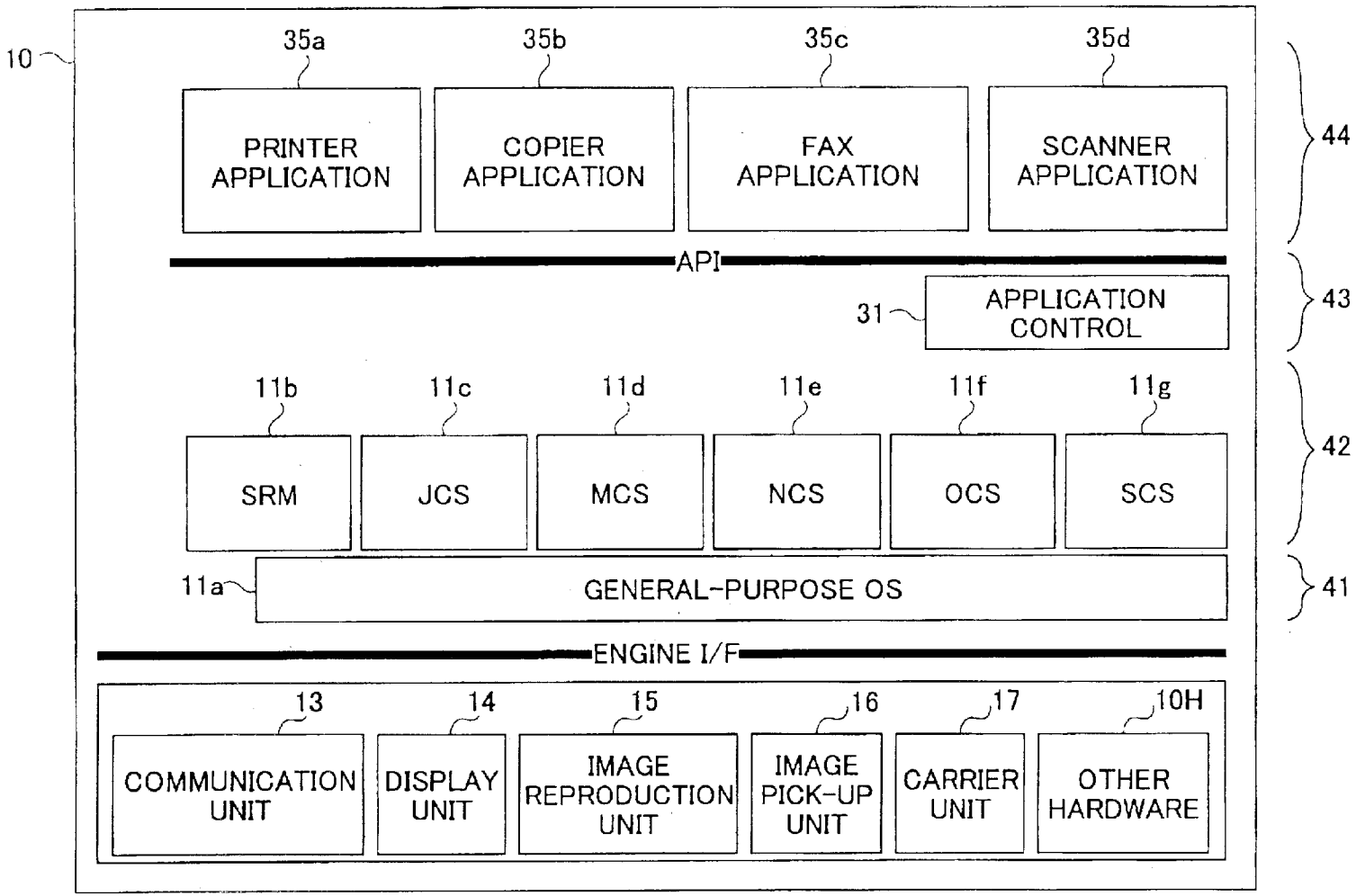
FIG. 2 shows a software structure of an imaging apparatus used in the first embodiment of the present invention.

FIG. 2 shows an architecture of the imaging apparatus 10. As shown in the drawing, a software layer is constructed on top of the hardware resources 10H with an engine I/F in between. This software layer includes an OS (operating system) layer 41 at the bottom, a service module layer 42 and an application control layer 43 in the middle, and an application module layer 44 at the top.

In the OS layer 41, a general-purpose OS 11*a* is mounted. The general-purpose OS 11*a* realizes parallel execution of the programs in the application module layer 44, the application control layer 43, and the service module layer 42, each of the programs being handled as processes. It is assumed that the imaging apparatus 10 according to the first embodiment implements an open source UNIX (registered trademark) operating system. This arrangement takes into consideration the accessibility of source code and the safety of the programs.

The application module layer 44 implements application programs such as a printer application 35*a*, a copier application 35*b*, a fax application 35*c*, and a scanner application 35*d*.

The printer application 35*a* is an application program for realizing a printing service and includes various application modules such as a PIR module, a print job generation module, a print data communication module, and a printer display and key manipulation module.

The copier application 35*b* is an application program for realizing a copying service, and includes application modules such as a copy job generation module, and a copy display and key manipulation module.

The fax application 35*c* is an application program for realizing a facsimile service, and includes a fax job generation module, and a fax display and key manipulation module.

The scanner application 35*d* is an application program for realizing a scanning service, and includes a scanner data transmission module, a scanner data communication module, and a scanner display and key manipulation module.

The imaging apparatus 10 shown in FIG. 2 normally has the above described four application programs implemented in the application module layer 44. However, a new version of an application can be added, or an application program can be deleted or added.

The application control layer 43 is inserted between the application module layer 44 and the service module layer 41, and implements the application control part 31.

The service module layer 41 includes a system resource manager (referred to as 'SRM' hereinafter) 11*b*, a job control service (referred to as 'JCS' hereinafter) 11*c*, a memory control service (referred to as 'MCS' hereinafter) 11*d*, a network control service (referred to as 'NCS' hereinafter) 11*e*, an operation-control service (referred to as 'OCS' hereinafter) 11*f*, and a system control service (referred to as 'SCS' hereinafter) 11*g*.

The SRM 11*b* is a program for controlling the system and managing the resources. The SRM 11*b* administers the control unit 11 to mediate between the hardware resources 10H such as the communication unit 13, the display unit 14, the image reproduction unit 15, and the image pick-up unit 16 according to the requirements of the application software in the upper layer. Also, the SRM 11*b* administers the control unit 11 to control the execution of the hardware resources 10H.

The JCR 11*c* administers the control unit 11 to successively produce jobs that control the hardware resources 10H to perform their respective user services according to instructions of a job mode accepted from each of the applications in the upper layer.

The MCS 11*d* administers the control unit 11 to perform memory control such as image memory acquisition and release, hard disk device usage, and image data compression and decompression.

The NCS 11*e* administers the control unit 11 to perform a mediation process between the network and each of the application programs in the application module layer 44. The imaging apparatus 10 is able to obtain new versions of each application program via the network to which the imaging apparatus 10 is connected by the NCS 11*e*.

The OCS 11*f* administers the control unit 11 to control the operation panel. The SCS 11*g* administers the control unit 11 to perform general management of the applications.

The service module layer 42 containing the above described services is placed between the general-purpose OS 11*a* at the bottom and the application module layer 44 at the top. In this way, the common portions for each of the application programs can be arranged as a common system service so that the development effort for each of the applications can be reduced and the application can be slimmed down. In order to realize such a common system service, the service module layer 42 provides an application program interface (API) to each of the application programs in the application module layer 44. Each of the application programs in the application module layer 44 calls the necessary functions from the service module layer 42 using this API, and provides notification of the current situation to the application control part 31.

For example, when the activation of the printer application 35*a* is directed, the necessary functions are called from the service module layer 42, and jobs that control the hardware resources 10H are generated. Then, the execution results of the jobs are provided to the application control part 31 as state data of the application.

Also, when the activation of the copier application 35*b*, fax application 35*c*, or the scanner application 35*d* is directed, the same applies wherein each application module calls the necessary functions from the service module layer 42, and generates jobs that control the hardware resources 10H. The job execution results are provided to the application control part 31 via the API.

Figure 3A:
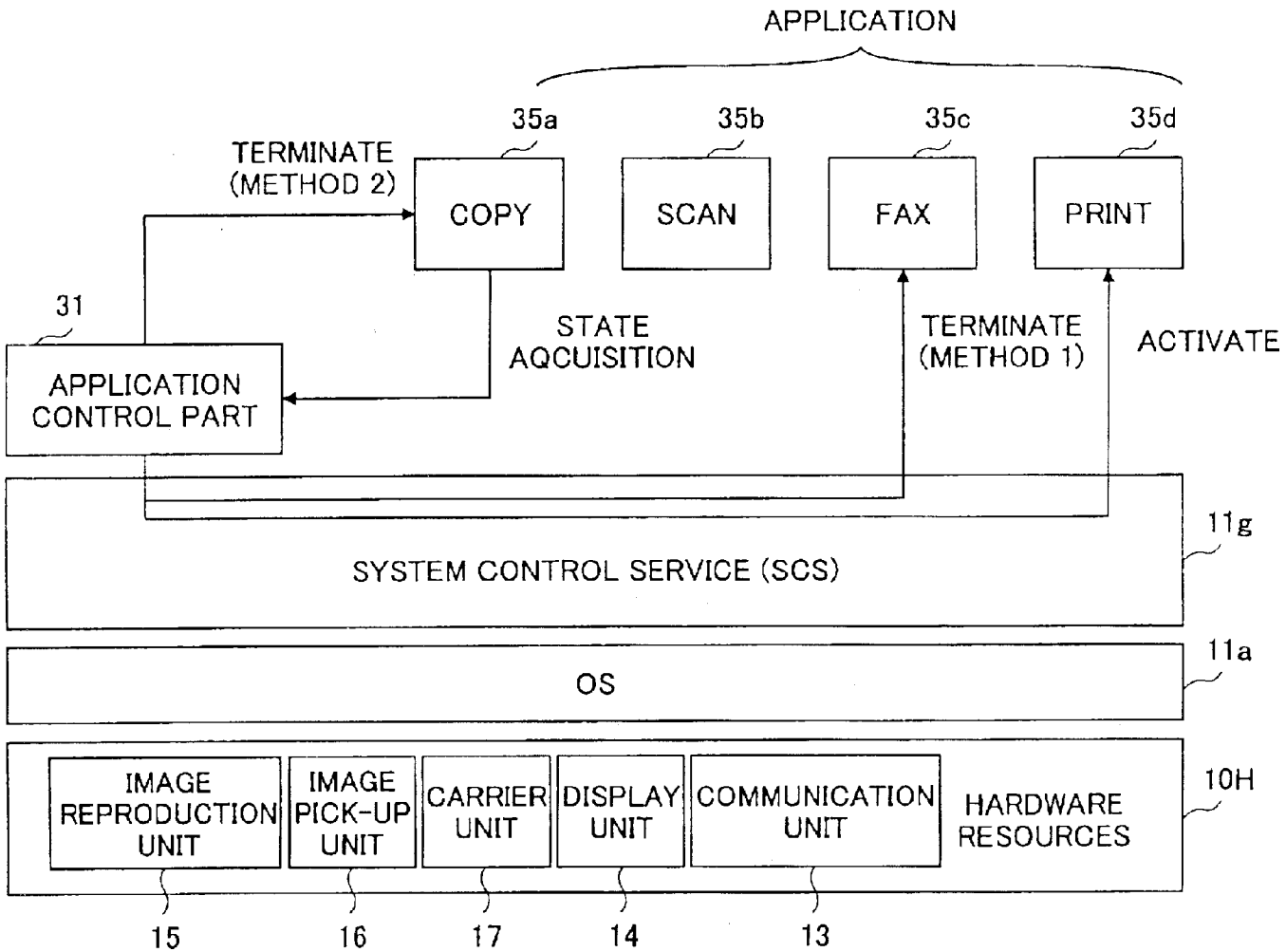
FIGS. 3A and 3B are diagrams illustrating operations of an application control part in the imaging apparatus, FIG. 3A illustrating an activation control and a termination control for each application realized by the application control part, and FIG. 3B illustrating a flow of information between the application control part, an application usage management table, the applications, and a system control service (SCS)
Figure 3B:
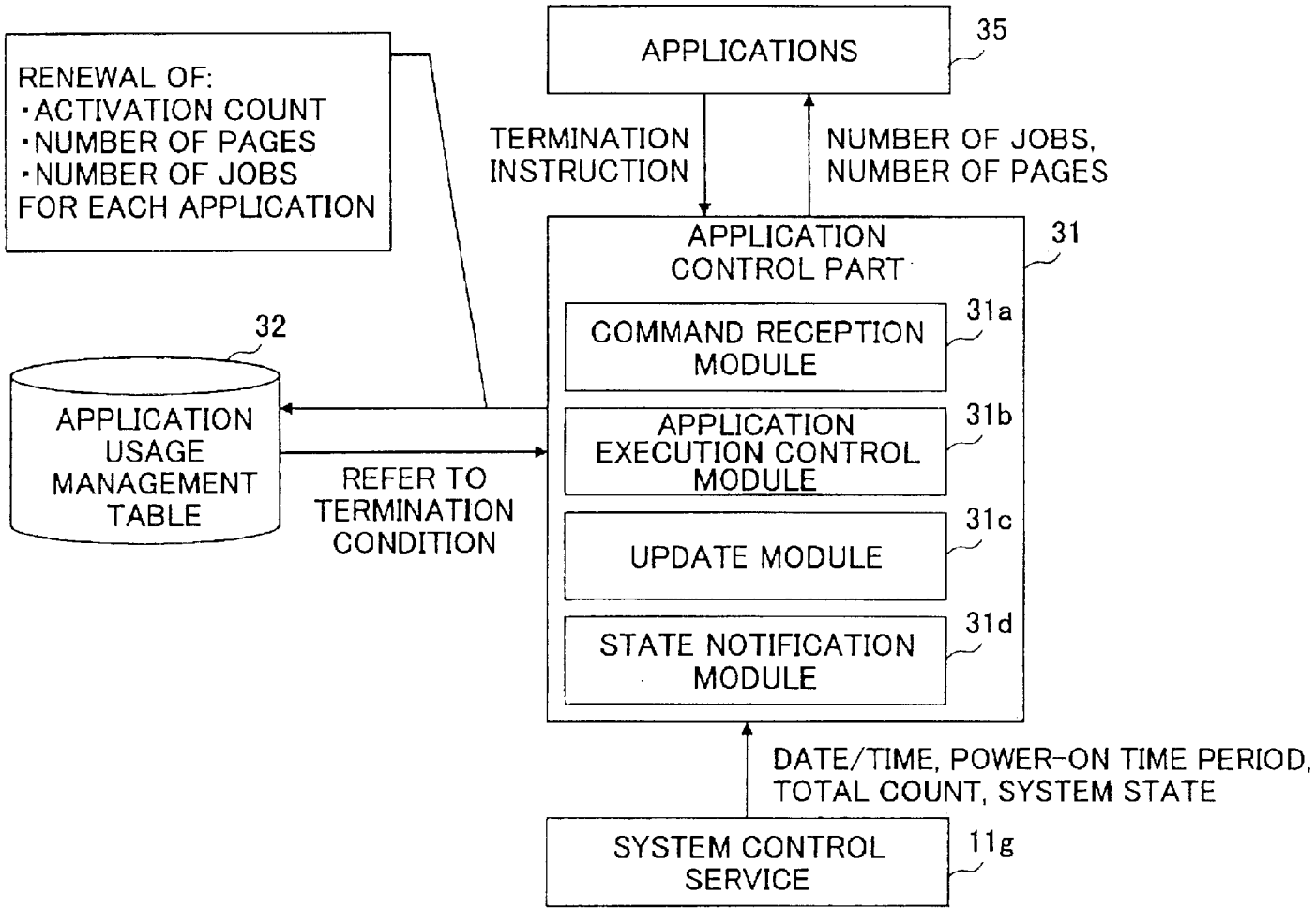

FIGS. 3A and 3B are diagrams showing the relationship between the application control part 31, the applications 35*a*–35*d*, and the system control service (SCS) 11*g*. As shown in FIG. 3A, the application control part 31 is inserted between the applications 35 at the top and the system control service (SCS) 11*g* at the bottom. The application control part 31 acquires the current state of each application and controls the activation and termination of each application.

The activation of an application is realized through the SCS 11*g*. Applications that are to be activated at the time the power source of the imaging apparatus 10 is switched on are pre-selected, and the initial state upon power-on of the imaging apparatus is designated for each of the applications. The application control part 31 refers to the application usage management table 32 at the time the power is turned on and activates only the required applications via the SCS 11*g*.

As for the termination of an application, the application control part 31 may terminate an operating application via the SCS 11*g* when a predetermined termination condition is satisfied (method 1) or the application control part 31 may directly terminate an application (method 2). Either method can be used for the termination of an application; however, the method of terminating an application via the SCS 11*g* (method 1) is preferable upon taking into account the necessity of securing and opening the system resources.

FIG. 3B shows the functions of the application control part 31 and the flow of information upon terminating an application. The application control part 31 includes a command reception module 31*a*, an application execution control module 31*b*, an update module 31*c*, and a state notification module 31*d*.

The command reception module 31*a* receives a command in a SOAP (simple object access protocol) format from the remote management apparatus 20 via the communication unit 13, and hands this to the application execution control module 31*b*. The application execution control module 31*b* directs the activation, execution, and termination of each application program according to the contents of the acquired command.

The application execution control module 31*b* acquires information such as the date and time, the elapsed time after power-on, the total counter value, and the system state from the system control service (SCS) 11*g*. The application execution control module 31*b* also acquires information such as the number of jobs and the number of pages for each of the applications. The number of jobs is the number of jobs executed by the application. The number of pages is the number of pages processed by the application.

The application execution control module 31*b* also counts the number of times each application has been activated (activation count).

Based on the above information, the update module 31*c* updates the contents (i.e. the activation count, the number of jobs, the number of pages, etc. for each application) of the application usage management table 32. Also, the state notification module 31*d* notifies the remote management apparatus 20 (see FIG. 1) of the states of the applications and the updated results of the application usage management table 32 via the communication unit 13.

The application execution control module 31*b* refers to the termination condition established in the application usage management table 32, and generates a termination instruction to the corresponding application, preferably via the system control service (SCS) 11*g*, when the termination condition is satisfied.

FIG. 4 shows a data structure of the application usage management table 32. The application usage management table 32 contains various fields such as the identifier, the version, the activation state, the activation count, the number of jobs, the number of pages, the termination condition, the activation command, and the initial state of each of the applications installed in the imaging apparatus 10. The above described update module 31*c* updates a predetermined field value of the application usage management table 32, and the state notification module 31*d* outputs the field value of the application usage management table 32 as a state notification. The state notification includes a notification of a change in the state of an application program. For example, a state change of a particular application program from an activated state to a terminated state or from a terminated state to an activated state is reported to the remote management apparatus 20. The state notification report also includes a condition change of an application program due to the updating of an activation condition (the field value of the 'initial state') or a termination condition (the field value of the 'termination condition') of the application program.

Figure 5:
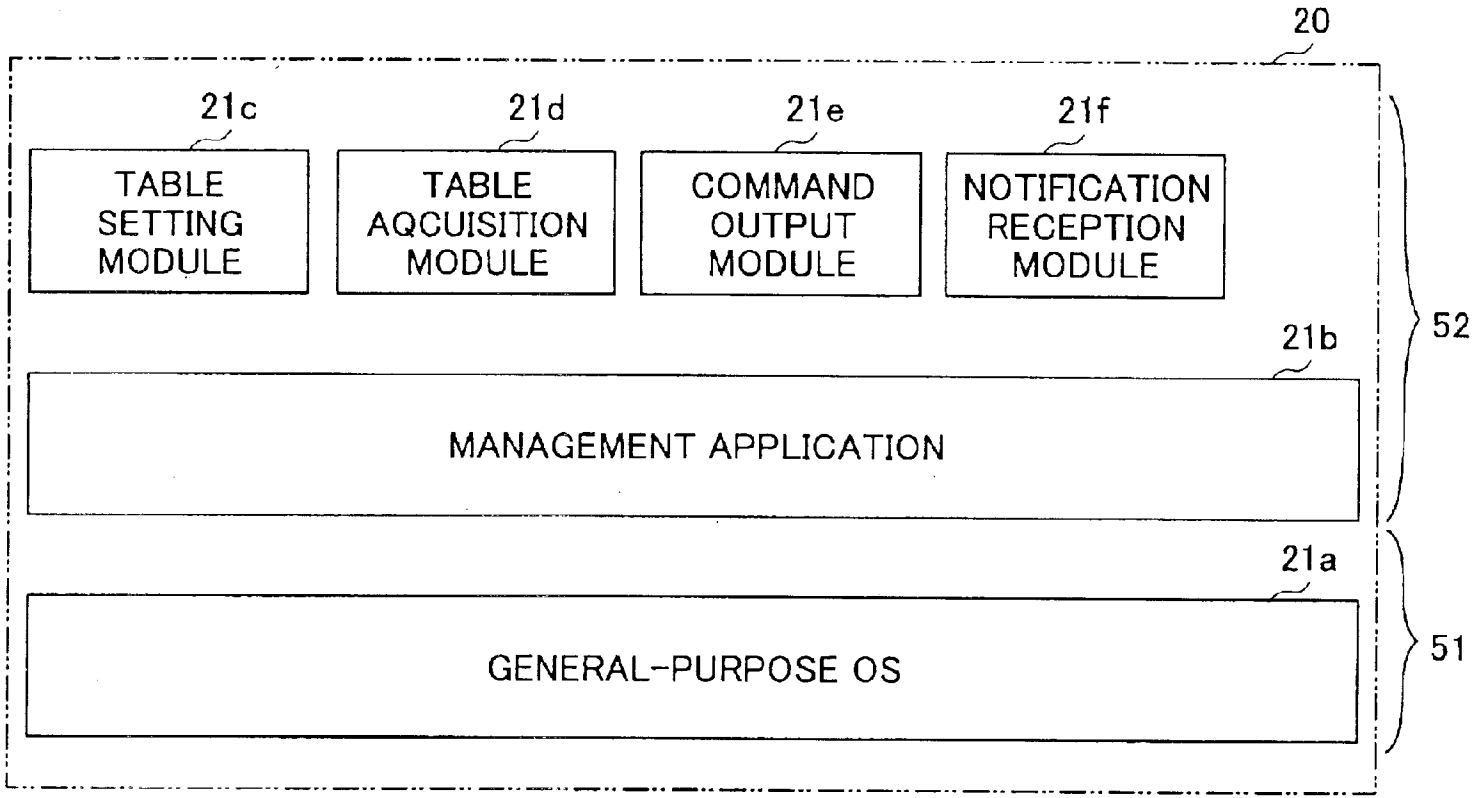
FIG. 5 shows a software structure of a remote management apparatus according to the first embodiment of the present invention.

FIG. 5 shows an architecture of the remote management apparatus 20. The remote management apparatus 20 includes an OS layer 51 and an application module layer 52.

In the OS layer 51, a general-purpose OS 21*a* is implemented. According to the first embodiment, the imaging apparatus 10 implements a UNIX (registered trademark) operating system. However, the operating system of the remote management apparatus 20 does not necessarily have to conform to the operating system of the imaging apparatus 10. As will be described later, in the first embodiment, the imaging apparatus 10 and the remote management apparatus 20 send/receive information to/from each other using a SOAP message expressed in XML (extensible markup language). Thus, the remote management apparatus 20 may implement a UNIX (registered trademark) OS, a Windows (registered trademark) OS, or some other OS.

The application module layer 52 of the remote management apparatus 20 includes a management application 21*b*, a table setting module 21*c* arranged above the management application 21*b*, a table acquisition module 21*d*, a command output module 21*e*, and a notification reception module 21*f*.

The table setting module 21*c* generates a command to update the predetermined field value in the application usage management table 32 of the imaging apparatus 10.

The table acquisition module 21*d* acquires the contents of the application usage management table 32 of the imaging apparatus 10 via the communication unit 23.

The command output module 21*e* outputs a SOAP message command for controlling the operation of the imaging apparatus 10.

The notification reception module 21*f* receives a state notification from the imaging apparatus 10 via the communication unit 23.

In the following, operations of the imaging apparatus 10 and the remote management apparatus 20 according to the first embodiment are described. In order to simplify the descriptions, the operations are divided into activation and termination processes and condition update command output processes of the applications.

Figure 6:
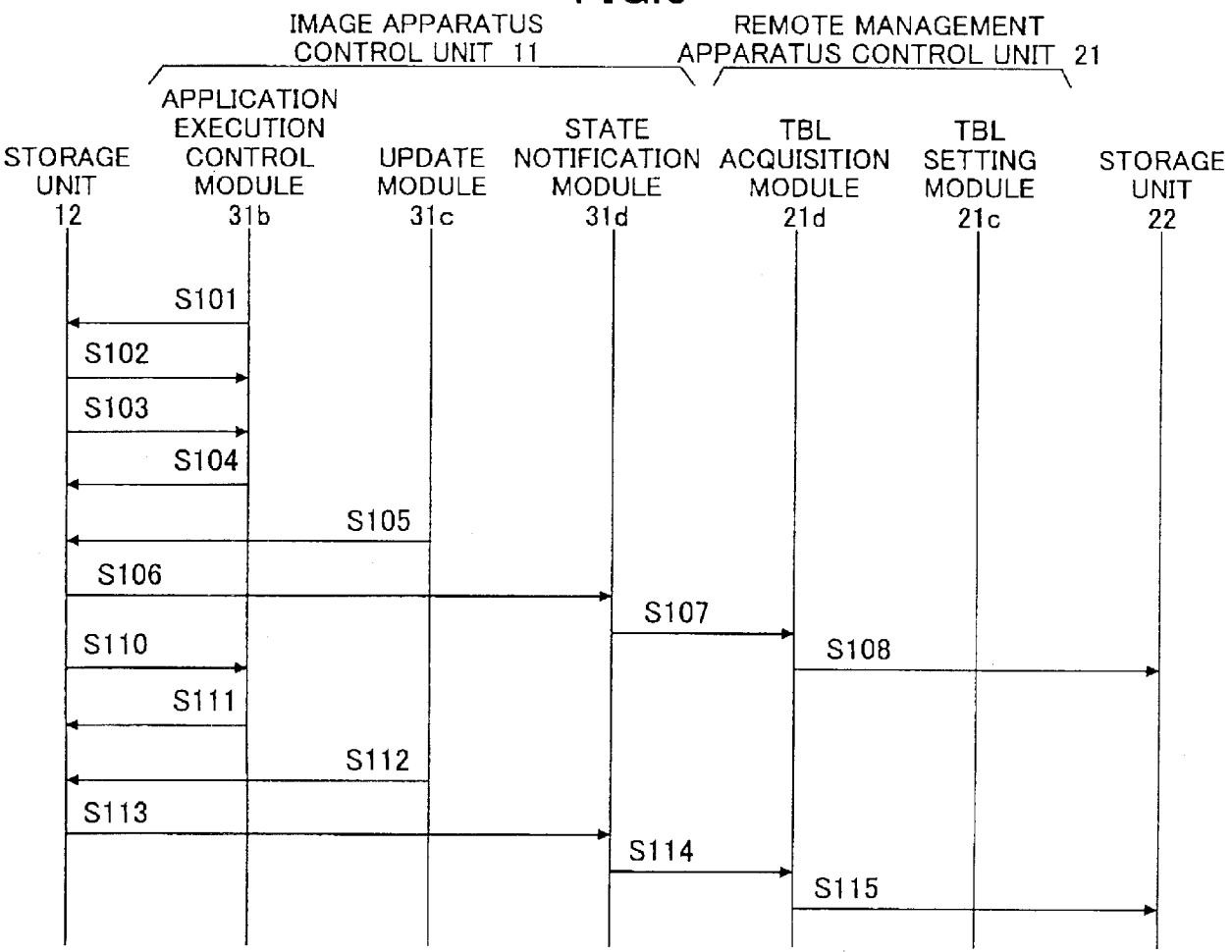
FIG. 6 is a sequence diagram illustrating activation and termination processes according to the first embodiment of the present invention.

FIG. 6 is a sequence diagram showing the activation and termination processes of an application. The activation process starts when power is supplied to the imaging apparatus 10 and the OS is activated. With the activation of the OS, the control unit 11 of the imaging apparatus 10 refers to the 'initial state' of the applications in the application usage management table 32 and starts the necessary application programs. On the other hand, the termination process is a process of terminating an application program when the corresponding termination condition defined in the application usage management table 32 is satisfied. In FIG. 6, the processes executed by each of the modules of the application control part 31 at the control unit 11 of the imaging apparatus 10 and the processes executed by each of the modules of the control unit 21 of the remote management apparatus 20 are shown as a sequence. Since the processes executed by the command reception module 31*a* of the imaging apparatus 10 and the notification reception module 21*f* of the remote management apparatus 20 are not directly relevant to the present invention, these processes are omitted from the drawings and descriptions.

First, when power is supplied to the imaging apparatus 10 from a main power source and the general-purpose OS 11*a* is activated, the control unit 11 of the imaging apparatus 10 (referred to as 'imaging apparatus control unit 11' hereinafter) initializes all the 'state' field values of the applications in the application usage management table 32 stored in the storage unit 12 to 'stop' (S101).

Then, the application execution control module 31*b* of the imaging apparatus control unit 11 refers to the field 'initial state' in the application usage management table 32 of the storage unit 12, and identifies the application programs that need to be activated upon activation of the imaging apparatus 10 (S102).

The application usage management table 32 manages the application programs that need to be activated upon the activation of the imaging apparatus 10 as field values of their 'initial state'. If this field is set to 'activate', the corresponding application program is activated along with the activation of the imaging apparatus 10. On the other hand, if the above field is set to 'terminate', the corresponding application program is not activated unless a command instructing its activation is received from the remote management apparatus 20. The above 'initial state' field values in the application usage management table 32 can be updated by a command acquired at an arbitrary timing from the remote management apparatus 20. This update process will be described later in connection with the description of the condition update command output processes.

Next, the application execution control module 31*b* of the imaging apparatus control unit 11 reads out the activation commands of the application modules that need to be activated from the field 'activation command' in the application usage management table 32 (S103).

Then, the application execution control module 31*b* directs the activation of the application programs that require activation based on the above read out activation commands (S104). As described above, the printer application 35*a*, the copier application 35*b*, the fax application 35*c*, and the scanner application 35*d* each have a plurality of application modules. When the activation of an application program is directed, each of the application modules of the application program calls a predetermined function from the service module layer 42 via the API (application program interface) and generates a job. Based on the generated job, the imaging apparatus control unit 11 controls the hardware resources 10H according to each user service.

Next, the update module 31*c* of the imaging apparatus control unit 11 changes the 'state' field value in the application usage management table 32 from 'terminate' to 'activate' for the application programs that have been directed to activate (S105).

Then, the state notification module 31*d* of the imaging apparatus control unit 11 reads out all the field values of the application usage management table 32 (S106). Herein, the read out field values will have the values that have been changed in the above update process in response to the activation of the imaging apparatus 10.

The state notification module 31*d* sends each of the read out field values to the remote management apparatus 20 via the communication unit 13 as a state notification (S107). In this way, the imaging apparatus 10 sends state notifications of the application usage management table 32 to the remote management apparatus 20 when its Os is activated. Also, the imaging apparatus 10 may send the state notifications to the remote management apparatus 20 upon receiving a command directing the transmission of the state notification from the remote management apparatus 20 at an arbitrary timing.

The state notification is sent as SOAP message text information. SOAP is a protocol for exchanging data composed of XML (extensible markup language) tags between remote applications in distributed environments. In a SOAP message, a name space or information type required for the applications to interpret the message is defined by a predetermined URL (uniform resource location) directory, and this URL can be described as an attribute of the XML tag of the SOAP message. In this way, the application that receives this SOAP message is able to interpret the structure of the received SOAP message by acquiring access to the described URL and referring to the directory.

FIG. 7A shows an example of a SOAP message sent from the imaging apparatus 10. This SOAP message is a state notification signaling that the scanner application 11*k* has been activated. In the attribute of the XML tag of this SOAP message, a URL defining the information for interpreting the structure of the SOAP message is described. The control unit 21 of the remote management apparatus 20 interprets the structure of the SOAP message received from the imagaing apparatus 10, and determines that the SOAP message is transmitting information of a state change that is indicated as "stateChanged ('scanner', 'activate')".

In the control unit 21 of the remote management apparatus 20 (referred to as remote management apparatus control unit 21 hereinafter), the table acquisition module 21*d* determines the current state of the application usage management table 32 of the imaging apparatus 10 based on the state notification received from the imaging apparatus 10 via the communication unit 23, and stores the contents of this application usage management table 32 in the storage unit 22 (S108).

Then, the remote management apparatus control unit 21 reads out the stored contents of the application usage management table 32 from the storage unit 22 and displays the contents on the display unit 24 in a predetermined layout. An operator of the remote management apparatus 20 refers to the displayed application usage management table 32, and if the operator judges that a change of a particular field value is necessary, this operator inputs the change via the input unit 25. A command based on this input information is sent to the imaging apparatus 10 as a command in a SOAP format. At the imaging apparatus 10, the contents of the application usage management table 32 are updated according to this command. Specific details of this update process will be described later in connection with the description of the condition update command output processes.

On the other hand, the application execution control module 31*b* of the imaging apparatus control unit 11 determines the termination condition for the application program that has been instructed to activate in the step S105 based on the 'termination condition' field value in the application usage management table 32 (S110).

The application execution control module 31*b* iteratively monitors the operation of the application program that has been instructed to activate to see whether or not the above determined termination condition has been satisfied due to the execution of a job and the like. If the termination condition is satisfied, the application execution control module 31*b* directs the termination of the corresponding application program or directs the prohibition of the activation of the application program (S111). The specific instruction for a particular application, this being either an instruction to end the application program or an instruction to prohibit the activation of the application program, depends on the termination condition established at the application usage management table 32. The process of determining whether or not the termination condition is satisfied also depends on the established termination condition.

For example, the termination conditions in the application usage management table 32 shown in FIG. 4 are based on the number of jobs, the number of pages, the activation count, and the termination timing.

In the example of a termination condition based on the number of jobs, the termination condition for the copier application 35*b* is set to: 'number of jobs>34'. The 'number of jobs' refers to the number of jobs generated by the copier application 35*b*. When the number of jobs generated by the copier application 35*b* exceeds 34, the application execution control module 31*b* directs the termination of the copier application 35*b*.

In the example of a termination condition based on the number of pages, the termination condition for the printer application 35*a* is set to: 'number of pages>130'. The 'number of pages' refers to the number of pages printed by the image reproduction unit 15. Since the image reproduction unit 15 has a sensor, the imaging apparatus 10 counts the number of output pages. When the total number of pages output by the imaging apparatus 10 exceeds 130, the application execution control module 31*b* directs the termination of the printer application 35*a*.

In the example of a termination condition based on the activation count, the termination condition for the scanner application 35*d* is set to: 'activation count>20'. The 'activation count' refers to the number of times the application has been activated. In the case where the termination condition for an application is based on the 'activation count', the application is prevented from being activated when the termination condition is satisfied. In the example of FIG. 4, the application execution control module 31*b* directs the prevention of the activation of the scanner application 35*d* when the number of times the scanner application is activated reaches 20. In this case, the scanner application 35*d* does not activate even when power is supplied to the imaging apparatus 10 from the main power source and the OS is activated with the exception of a case in which the remote management apparatus 20 sends an instruction to change the 'initial state' of the application usage management table 32 in the condition update command output processes, which will be described later.

In the example of a termination condition based on the termination timing, the termination condition for the fax application 35*c* is set to: 'date>Dec. 17'. The imaging apparatus 10 has a timer (not shown) that manages the termination timing established as the termination condition. By referring to this timer, the application execution control module 31*b* instructs the termination of the fax application 35*c* when the date December 17 passes.

The update module 31*c* of the imaging apparatus control unit 11 updates the 'state' field values of the application usage management table 32 from 'activated' to 'terminated' for the application programs that have been instructed to terminate or that are prevented from activating in step S111 (S112).

The state notification module 31*d* of the imaging apparatus control unit 11 reads out the updated 'state' field values of the application usage management table 32 (S113).

The state notification module 31*d* sends the read out field values as state change notifications to the remote management apparatus 20 via the communication unit 13 (S114). This state change notification is sent as text information of a SOAP message.

FIG. 7B shows an example of a SOAP message for signaling that the scanner application 35*d* has been terminated. As described above, in a SOAP message, the name space or the information type is defined by a directory of a predetermined URL (uniform resource location), and this URL is described as an attribute of the XML tag of the SOAP message. Thus, the remote management apparatus 20 that acquires the SOAP message of FIG. 7B is able to interpret the structure of this SOAP message by gaining access to the address described as the attribute of this XML tag and referring to its definition information. Consequently, it is determined that the acquired SOAP message is signaling a state change indicated as: "stateChanged ('scanner', 'terminate')".

The table acquisition module 21*d* of the remote management apparatus control unit 21 stores the state change notifications received from the imaging apparatus 10 via the communication unit 23 in the storage unit 22 (S115). The remote management apparatus control unit 21 reads out the contents of the stored state change notifications from the storage unit 22, and displays these contents on the display unit 24 in a predetermined layout. In this way, the operator of the remote management apparatus 20 is able to be aware of the change in the activation state of a particular application in the imaging apparatus 10 (the scanner application in the case of FIG. 7B).

Figure 8:
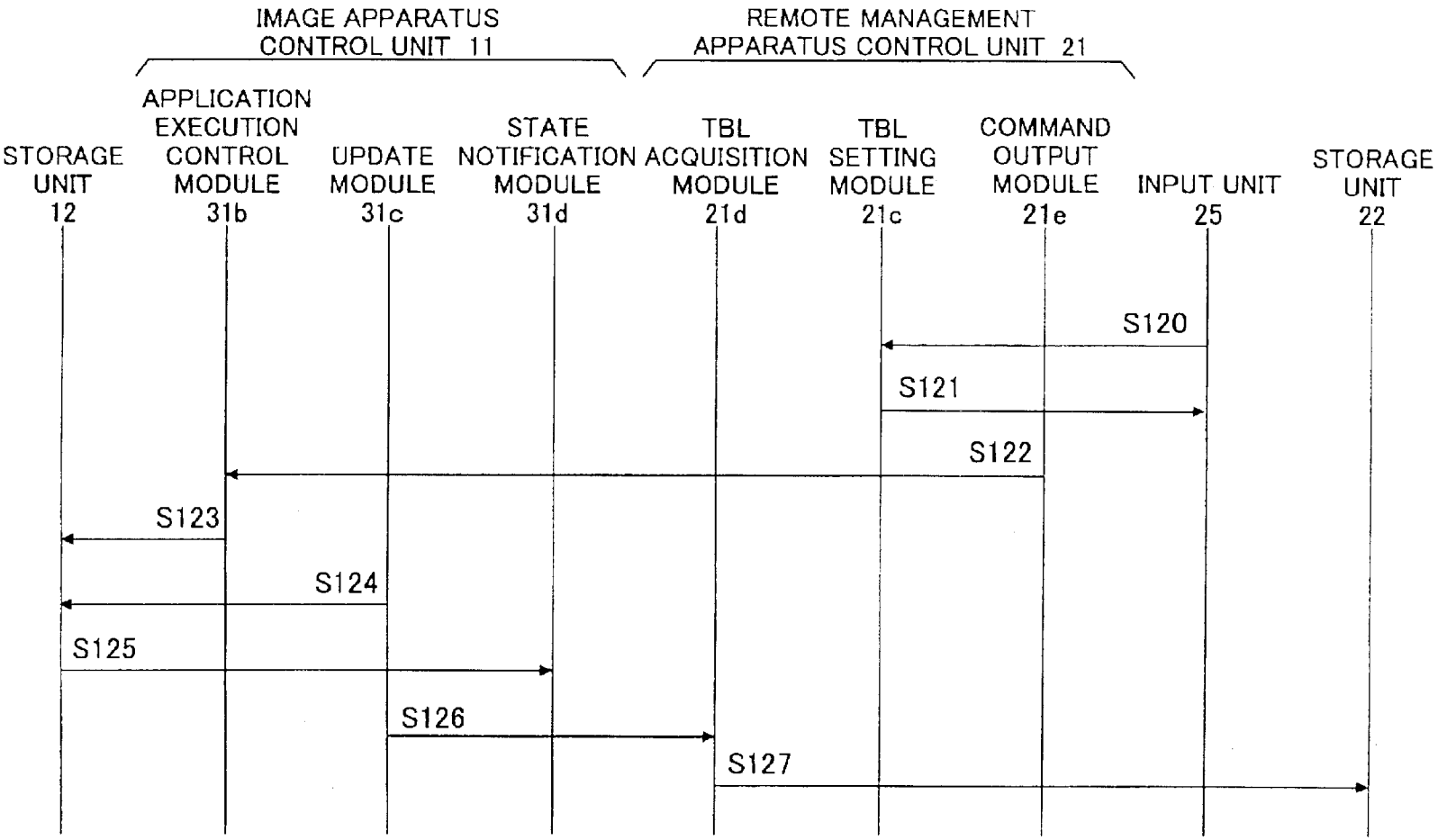
FIG. 8 is a sequence diagram illustrating condition update command output processes performed at the imaging apparatus and the remote management apparatus.

FIG. 8 is a sequence diagram illustrating the condition update command output processes. The condition update command output processes are processes for reflecting condition change instructions in the application usage management table 32 at the imaging apparatus 10. The condition change instruction, which is generated at the remote management apparatus 20, may be an instruction to change the termination condition or the initial setting of an application. An operator may input the condition change instruction to the remote management apparatus 20 when the state changes of the imaging apparatus 10 are displayed on the display unit 24, or the operator may otherwise input the instruction at an arbitrary timing. Alternatively, the condition change instruction may be automatically input by arranging the remote management apparatus 20 to be connected to a web page (not shown).

The table setting module 21*c* of the remote management apparatus control unit 21 acquires an instruction to change the setting of the 'initial state' or the 'termination condition' from the input unit 25 (S120). In the first embodiment, the updating of the 'initial state' field value and the 'termination condition' field value in the application usage management table 32 of the imaging apparatus 10 at the remote management apparatus 20 are described as examples. However, other fields having changeable conditions may be established in accordance with the configuration of the application usage management table 32 implemented in the imaging apparatus 10. In the following, a case in which the operator changes the 'termination condition' for terminating the scanner application 35*d* via the input unit 25 is described as an example.

The table setting module 21*c* generates an update command corresponding to the input information (S121). For example, this table setting module 21*c* generates a command to update the 'termination condition' field value of the scanner application 35*d* in the application usage management table 32 of the imaging apparatus 10.

The command output module 21*e* of the remote management apparatus control unit 21 sends the generated command to the imaging apparatus 10 via the communication unit 23 (S122). This update instruction command is also sent as text information of a SOAP message.

FIG. 9 shows an example of a command directing the updating of the 'termination condition' field value of the scanner application 35*d*. In a SOAP message, the name space or the information type is defined by a directory of a predetermined URL (uniform resource location), and this URL is described as an attribute of the XML tag of the SOAP message. Thus, the imaging apparatus 10 is able to interpret the structure of this SOAP message shown in FIG. 9 by gaining access to the address described as the attribute of this XML tag and referring to its definition information. As a result, it is determined that the acquired SOAP message is sending an update command indicated as: "modifyTable ('application usage management table', 'scanner', 'termination condition'='number of pages>150')".

The application execution control module 31*b* of the imaging apparatus control unit 11 determines the content of the command received via the communication unit 13, and stores this in the storage unit 12 (S123).

The update module 31*c* of the imaging apparatus control unit 11 updates the 'termination condition' field value in the application usage management table 32 stored in the storage unit 12 to 'number of pages>150' based on the content of the determined update instruction command (S124).

The state notification module 31*d* of the imaging apparatus control unit 11 reads out each field value of the updated application usage management table 32 (S125), and sends the read out field values as state change notifications to the remote management apparatus 20 via the communication unit 13 (S126). These state change notifications are also sent as text information of SOAP messages.

The table acquisition module 21*d* of the remote management apparatus control unit 21 stores the state notifications acquired from the imaging apparatus 10 in the storage unit 22 (S127). The remote management apparatus control unit 21 reads out the contents of the state notifications from the storage unit 22 and displays the contents on the display unit 24 in a predetermined layout. In this way, the operator of the remote management apparatus 20 is able to verify that the condition update instruction that has been input by this operator is properly reflected in the application usage management table 32 of the imaging apparatus 10.

As described above, according to the first embodiment of the present invention, the activation condition and termination condition of the imaging apparatus 10 are set and changed at the remote management apparatus 20; however, the conditions that have been set or changed are managed at the application control part 31 of the imaging apparatus 10. Therefore, even when a problem occurs in the network 50, the operation of each application in the imaging apparatus 10 can be accurately terminated and activated within the imaging apparatus 10 based on the pre-set termination condition and the activation condition (initial state). Also, since all the state changes in the imaging apparatus 10 are provided to the remote management apparatus 20, the remote management apparatus 20 is able to generate an instruction to update an activation condition or a termination condition at the appropriate occasion.

In the above example, four factors, namely, the 'number of jobs', the 'number of pages', the 'activation count' and the 'termination timing' are set to be the termination conditions; however, the present invention is not limited to these examples. Whatever termination condition the remote management apparatus 20 sets, the imaging apparatus 10 will take this termination condition into the application usage management table 32. The application control part 31 manages the termination condition and usage situation of each application by referring to the application usage management table 32. In such a configuration, even when some kind of trouble erupts in the network 50, the termination operation of each application can be properly controlled at the imaging apparatus 10 side.

When a field value of the 'state'; 'initial state', or the 'termination condition' of the application usage management table 32 in the imaging apparatus 10 is updated, a change notification of this change is sent to the remote management apparatus 20. Thus, the operator of the remote management apparatus 20 is able to monitor the activation state of each application program in the imaging apparatus 10 in real time.

In the first embodiment, information exchange between the imaging apparatus 10 and the remote management apparatus 20 is realized using text information in a SOAP format. Although the present invention is not limited to this example, the use of SOAP messages for transmitting and receiving information is advantageous in that connection can be easily established between remote applications with simple procedures regardless of a difference in the platforms implemented in the transmitting apparatus and the receiving apparatus. This can be realized because the method name for handing data or the parameter for the method in a SOAP message is described as an XML tag, and the address defining the information for interpreting the message structure is described as an attribute of the XML tag. In XML, the types of tags describing each element can be extended, and thus, data described in XML can be easily adapted to situations in which commands controlling the operation of the imaging apparatus 10 are increased due to a version upgrade of an application program and the like.

Also, communication in the SOAP format is generally performed using only the HTTP. Therefore, even if a fire wall is installed in the communication path between the imaging apparatus 10 and the remote management apparatus 20, the SOAP message will not be vulnerable to rejection being made according to this countermeasure.

In the following, an imaging apparatus and a remote management system according to a second embodiment of the present invention will be described with reference to FIGS. 10–14.

In the first embodiment, conditions for the activation and termination of the applications in the imaging apparatus 10 such as the termination condition and the initial state are set or updated at the remote management apparatus 20, and the imaging apparatus 10 takes the conditions set or updated at the remote management apparatus 20 into the application usage management table 32 to manage these conditions and control the activation and termination of its applications at the imaging apparatus 10 itself.

The second embodiment includes the expiration of a valid period as a termination condition in addition to the features of the first embodiment. A valid period ends when a contract period expires, for example. The expiration time of each application is managed by the remote management apparatus 20. The imaging apparatus 10 receives a command regarding the expiration time from the remote management apparatus 20 at a predetermined timing, and activates or terminates the corresponding application program in real time.

Figure 10:
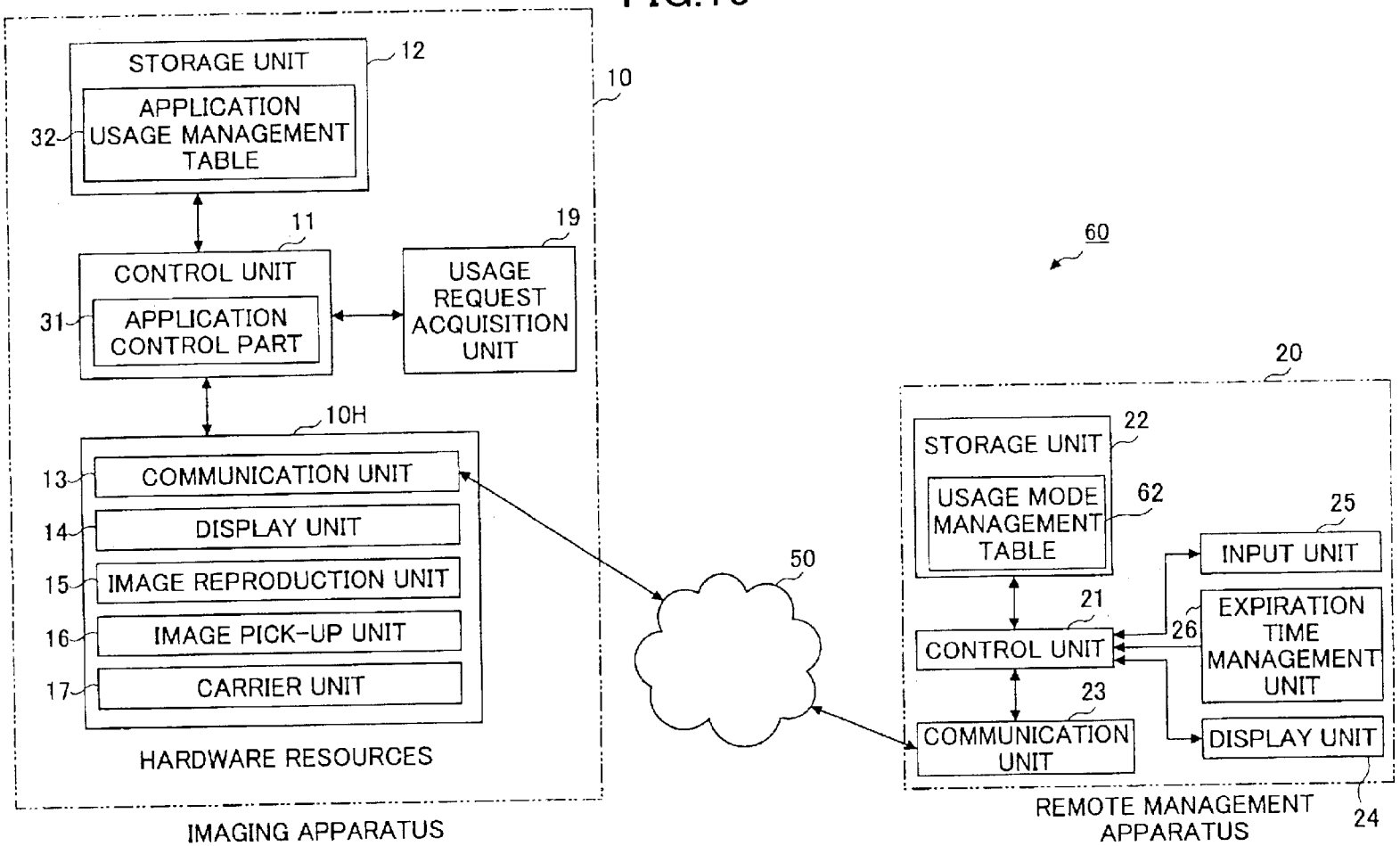
FIG. 10 shows an overall configuration of a remote management system according to a second embodiment of the present invention.

FIG. 10 shows an overall configuration of a remote management system 60 according to the second embodiment of the present invention. The configuration of the imaging apparatus 10 is identical to that of the first embodiment. The remote management apparatus 20 has an expiration time management unit 26 in addition to the control unit 21, the storage unit 22, the communication unit 23, the display unit 24, and the input unit 25. Also, the storage unit 22 stores a usage mode management table 62. The expiration time management unit 26 manages the activation of an application program, and also manages the expiration time pre-set as a termination condition based on the time of activation. The expiration time management unit 26 may have a timer mechanism, for example.

FIG. 11 shows a data structure of the usage mode management table 62 stored in the storage unit 22. The usage mode management table 62 keeps track of the setting of the initial state and termination condition of each application. The usage mode management table 62 stores an identifier of each imaging apparatus 10 as a main key. The remote management apparatus 20 assigns a different identifier to each imaging apparatus 10 so as to control the operations of a plurality of imaging apparatuses 10. In this way, the imaging apparatus 10 can be unambiguously identified.

In relation to the identifier of an imaging apparatus 10, which is the main key, the fields 'application identifier', 'initial setting' and 'termination condition' are provided. The field value of the 'initial setting' is set to either 'activate' or 'terminate'. For the application of which the 'initial setting' is set to 'activate', a command to activate this application program is output from the remote management apparatus 20 when the power is turned on at an imaging apparatus 10 that has this application program.

Also, in the 'termination condition' field value, the allowed time period from the activation of the application program until the termination of the application program is pre-set as the termination condition. The remote management apparatus 20 outputs a command to the imaging apparatus 10 directing the activation of an application. When the pre-set time period (valid time) runs out, the remote management apparatus 20 outputs a command to the imaging apparatus 10 once more, this time directing the termination of the application program.

Figure 12:
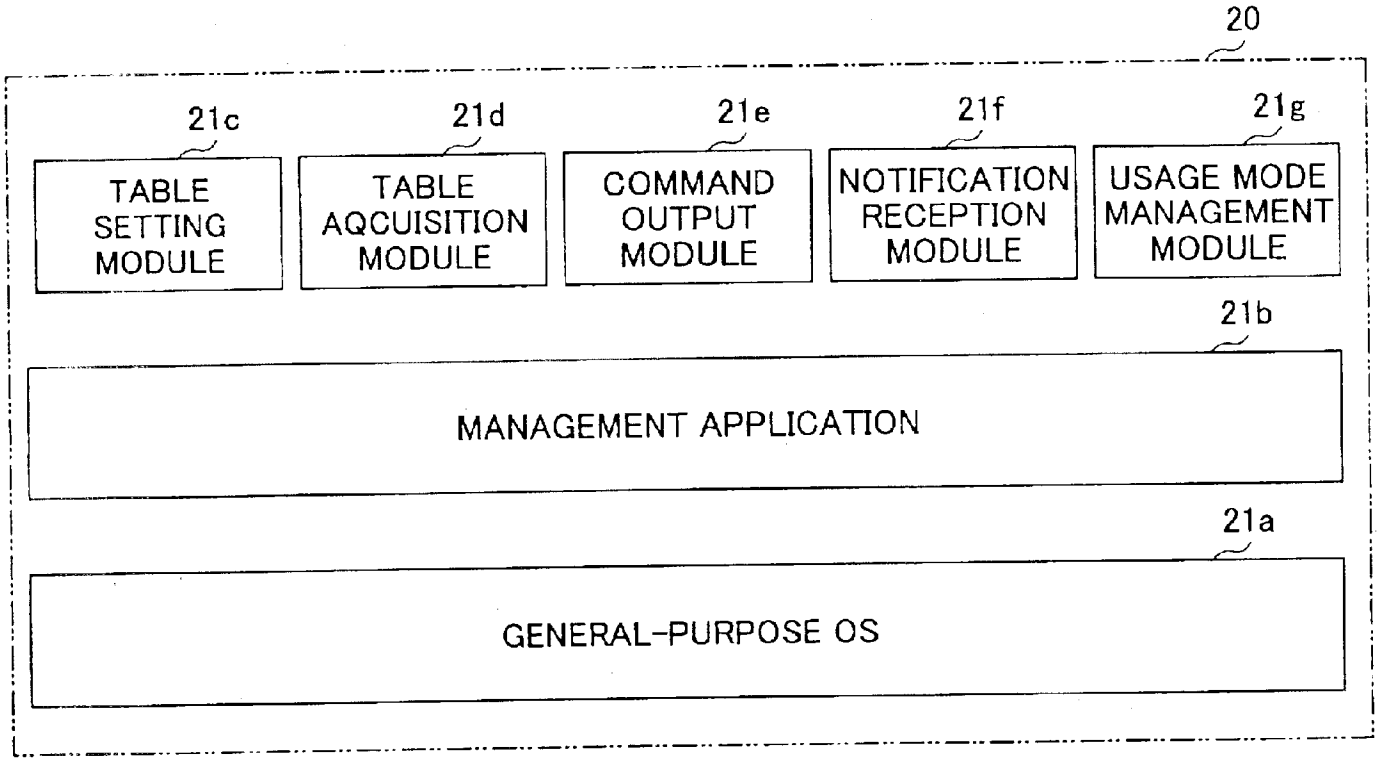
FIG. 12 shows a software structure of the remote management apparatus according to the second embodiment of the present invention.

FIG. 12 shows a software structure of the remote management apparatus 20 according to the second embodiment. In the second embodiment, the remote management apparatus 20 has a usage mode management module 21*g* implemented in the application layer. The usage mode management module 21*g* identifies the application programs that need to be activated from the start for each imaging apparatus 10 and generates activation commands for the identified application programs based on the contents of the usage mode management table 62 stored in the storage unit 22.

Figure 13:
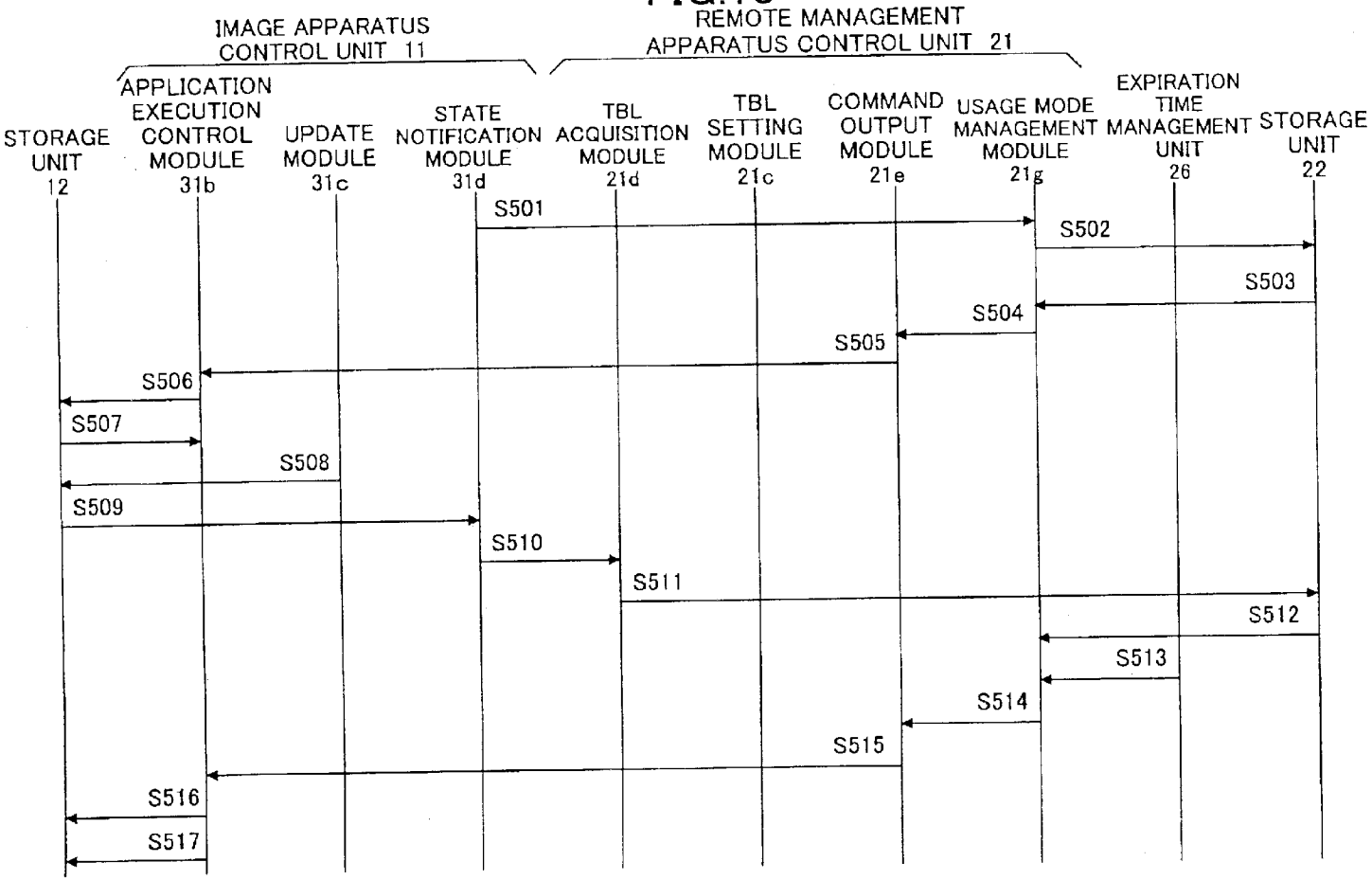
FIG. 13 is a sequence diagram illustrating the activation and termination processes performed at the imaging apparatus and the remote management apparatus according to the second embodiment of the present invention.

FIG. 13 is a sequence diagram illustrating the activation and termination processes between the imaging apparatus 10 and the remote management apparatus 20 according to the second embodiment.

First, the imaging apparatus 10 acquires a service usage request from a user via the usage request acquisition unit 19 while in operation. The state notification module 31*d* in the imaging apparatus control unit 11 sends the usage request for the user as a usage request notification to the remote management apparatus 20 via the communication unit 13 (S501). This usage request notification is also sent as text information of a SOAP message like the other state notifications.

The remote management apparatus control unit 21 receives the usage request notification from the imaging apparatus 10 via the communication unit 23 and stores this in the storage unit 22 (S502).

The usage mode management module 21*g* of the remote management apparatus control unit 21 identifies the application programs that realize the operation according to the usage request from the imaging apparatus 10 by referring to the usage mode management table 62 (S503).

The usage mode management module 21*g* generates an activation command for the identified application program and supplies this to the command output module 21*e* (S504). Alternatively, the generated command may be stored in the storage unit 22 and the command output module 21*e* may read the generated command from the storage unit 22 (not shown).

Taking the imaging apparatus 10 with the identifier '11011' stored in the usage mode management table 62 as an example, the initial setting for the copier application, the printer application, and the scanner application is set to 'activate'. The fax application is set to 'terminate', which means that it will not be instructed to activate. Thus, when the remote management apparatus 20 receives the usage request notification from the '11011' imaging apparatus 10, an activation instruction command for each of the copier application, the printer application, and the scanner application is generated at the usage mode management module 21*g*.

The command output module 21*e* of the remote management apparatus control unit 21 sends the generated activation instruction commands to the imaging apparatus 10 via the communication unit 23 (S505). The activation instruction command is also sent as text information of a SOAP message.

FIG. 14A shows an example of an activation instruction command that directs the activation of the scanner application. As described above, in a SOAP message, the name space or the information type is defined by a directory of a predetermined URL (uniform resource location), and this URL is described as an attribute of the XML tag of the SOAP message. Thus, the imaging apparatus 10 is able to interpret the structure of this SOAP message by gaining access to the address described as the attribute of the XML tag in the SOAP message and referring to its definition information. In the example of FIG. 14A, the imaging apparatus 10 identifies the SOAP message sent from the remote management apparatus 20 as information conveying an instruction command indicated as: "changeState ('scanner', 'activate')". Based on the identified command, the imaging apparatus control unit 11 determines that the application program that should be activated is the scanner application, and thereby instructs this scanner application to activate.

More specifically, the application execution control module 31*b* in the imaging apparatus control unit 11 interprets the activation instruction command received via the communication unit 13 and stores this in the storage unit 12 (S506).

The application execution control module 31*b* reads this command from the storage unit 12 and directs the activation of the application program to which this command is directed (S507).

The update module 31*c* of the imaging apparatus control unit 11 changes the 'state' field value in the application usage management table 32 (see FIG. 4) of the corresponding application program from 'terminated' to 'activated' (S508).

In the above example, the activation instruction command directs the activation of the scanner application, and thereby, the 'state' field value for the scanner in the application usage management table 32 is changed from 'terminated' to 'activated'.

The state notification module 31*d* of the imaging apparatus control unit 11 reads the updated field value from the application usage management table 32 (S509).

Then, the read out field value is sent to the remote management apparatus 20 via the communication unit 13 as a state change notification (S510). This state change notification is also sent as text information of a SOAP message.

The table acquisition module 21*d* of the remote management apparatus control unit 21 receives the state change notification sent from the imaging apparatus 10 via the communication unit 23 and stores this in the storage unit 22 (S511). The remote management apparatus control unit 21 reads the stored state change notification from the storage unit 22 on a suitable occasion, and displays this on the display unit 24 in a predetermined layout. In this way, the operator of the remote management apparatus 20 is able to verify that each application in the imaging apparatus 10 is properly activated according to the contents of the usage mode management table 62.

The usage mode management module 21*g* of the imaging apparatus control unit 11 identifies the termination condition of the application program that has been instructed to activate in step S505 by referring to the 'termination condition' field value in the usage mode management table 62 (S512). Then, the usage mode management module 21*g* iteratively makes inquires of the expiration time management unit 26 to see whether or not the expiration time set as the termination condition has passed (S513).

If it is determined that the expiration time has passed, the usage mode management module 21*g* generates a termination command to terminate the application program that has been instructed to activate in step S505, and supplies this command to the command output module 21*e* (S514). Alternatively, this termination command may temporarily be stored in the storage unit 22 and the command output module 21*e* may read this termination command from the storage unit 22 (not shown).

The command output module 21*e* of the remote management apparatus control unit 21 sends the termination command to the imaging apparatus 10 via the communication unit 23 (S515). This termination instruction command is also sent as text information of a SOAP message.

FIG. 14B shows an example of a termination instruction command that directs the termination of the scanner application. The imaging apparatus 10 interprets the structure of the acquired SOAP message by gaining access to the address described as the attribute of the XML tag in the SOAP message and referring to the definition information. As a result, the SOAP message is identified as information conveying an instruction command indicated as: "changeState ('scanner', 'terminate')". Based on the interpretation of this command, the imaging apparatus control unit 11 determines that the application program that should be terminated is the scanner application, and thereby instructs this scanner application to terminate.

More specifically, the application execution control module 31*b* stores the content of the termination command received via the communication unit 13 in the storage unit 12 (S516). Then, the application execution control module 31*b* reads the stored termination instruction command from the storage unit 12 and directs the termination of the application program to which the command is directed (S517).

After the application program is terminated in accordance with the termination instruction, the update module 31*c* updates the 'state' field value in the application usage management table 32 and this information is sent to the remote management apparatus 20 as a state change notification. These processes are identical to the above described steps S508 through S511, and thus, their descriptions will be omitted.

According to the second embodiment, an application usage management table in accordance with the usage mode (contract specifications) of each imaging apparatus 10 is provided in the remote management apparatus 20, and based on this table, the remote management apparatus 20 outputs a different activation instruction command for each of the applications in each of the imaging apparatuses 10. This arrangement prevents an application that is seldom used from taking up memory space in the imaging apparatus 10 and contributes to realizing a user-friendly imaging apparatus 10.

Also, in the second embodiment, the application usage expiration time for each application of each imaging apparatus 10 is managed at the remote management apparatus 20, and a termination instruction command is individually output for each application upon the expiration of its valid time. The imaging apparatus 10 properly terminates the application of which the valid time has expired based on the termination instruction command sent from the remote management apparatus 20 and hinders its use thereafter.

In the SOAP, elements of the XML tag that cannot be understood are skipped unless a special attribute, a 'mustUnderstatnd' attribute, for example, is allocated. Thereby, the remote management apparatus 20 is able to send commands for activating or terminating a plurality of applications at once, the applications being identified and selected with regard to the usage mode management table 62. Upon the transmission of the commands, there is no need to heed details such as whether a portion of the application program corresponding to a command has already been deleted or upgraded in the imaging apparatus 10. The imaging apparatus 10 receiving the command in the SOAP format can be programmed to perform only the processes corresponding to the SOAP messages that are relevant to the control of application programs that are currently implemented in the imaging apparatus 10.

Further, the present invention is not limited to the above described embodiments, and variations and modifications may be made without departing from the scope of the present invention. For example, in the first embodiment, the timing for the operator of the remote management apparatus 20 to direct the updating of the application usage management table 32 of the imaging apparatus 10 is not limited to the point at which the state notification (including the sate change notification) is acquired. The instruction to update can be input at an arbitrary timing at the remote management apparatus 20, and its content can be accurately reflected in the imaging apparatus 10 by means of the application control part 31.

Also, in the second embodiment, the timing for the remote management apparatus 20 to output a command for activation or termination of the application program of the imaging apparatus 10 is not limited to the point at which the usage request acquisition notification is received from the imaging apparatus 10. The operator of the remote management apparatus 20 may input an instruction command for activating or terminating an application program of the imaging apparatus 10 at an arbitrary timing and transmit this to the imaging apparatus 10. The imaging apparatus 10 is able to activate or terminate a particular application program in real time according to the activation/termination instruction command from the remote management apparatus 20.

Also, in the embodiments of the present invention, the setting or updating of the termination or activation condition of an application in the application usage management table is realized by sending a corresponding command from the remote management apparatus via a network; however, this can also be realized by a service person who makes a direct input to the imaging apparatus during a maintenance check and the like.

According to the present invention, the activation and termination conditions of each of a plurality of applications implemented in an imaging apparatus are set or updated at a remote location, and the termination conditions for each of the application programs are managed at the imaging apparatus so as to be able to control the activation and termination operations of an application.

Further, by managing the application usage expiration time of each application in each of a plurality of imaging apparatuses at a remote location, and sending a termination instruction to the imaging apparatus for an application of which the expiration time has been reached, the application programs of the imaging apparatus can be properly terminated.

The present application is based on and claims the benefit of the earlier filing date of Japanese priority application No. 2002-083329 filed on Mar. 25, 2002, and Japanese priority application No. 2003-067159 filed on Mar. 12, 2003, the entire contents of which are hereby incorporated by reference.

What is claimed is:

1. An imaging apparatus that implements a plurality of different applications, comprising:

a communication unit that transmits information to an external apparatus and receives information including a termination condition for each of the applications from the external apparatus;

a table that records an application usage state and a termination condition set by the external apparatus for each of the applications; and a control unit that records into the table the termination condition received from the external apparatus, determines whether or not any of the applications satisfies said termination condition during activation by referring to the table, and terminates said application when the termination condition is satisfied.

2. The imaging apparatus as claimed in claim 1, wherein:

the control unit notifies the external apparatus of a termination of said application via the communication unit when said application is terminated.

3. The imaging apparatus as claimed in claim 1, wherein:

the communication unit receives first update information for changing the termination condition from the external apparatus; and the control unit updates the table based on said first update information.

4. The imaging apparatus as claimed in claim 3, wherein:

the control unit sends a notification of an update result to the external apparatus via the communication unit when the table is updated.

5. The imaging apparatus as claimed in claim 1, wherein:

the communication unit receives a termination instruction for each application from the external apparatus; and the control unit terminates the corresponding application based on the termination instruction.

6. The imaging apparatus as claimed in claim 1, wherein:

the table also records an initial state that indicates whether or not the application is to be activated upon power-on of the imaging apparatus; and the control unit activates the application that needs to be activated by referring to the table.

7. The imaging apparatus as claimed in claim 6, wherein:

the initial state is determined by the external apparatus; and the control unit receives the initial state from the external apparatus via the communication unit, and records the initial state in the table.

8. The imaging apparatus as claimed in claim 6, wherein:

the communication unit receives update information for changing the initial state from the external apparatus; and the control unit updates the table based on said update information.

9. The imaging apparatus as claimed in claim 8, wherein:

the control unit sends a notification of an updating result of the table to the external apparatus via the communication unit when the table is updated.

10. The imaging apparatus as claimed in claim 1, wherein:

the control unit includes a system control part that provides an algorithm that is common to the plurality of different applications, and an application control part that is inserted between said system control part and the applications; and the application control part terminates the corresponding application via the system control part when the termination condition is satisfied.

11. A remote management system, comprising:

an imaging apparatus implementing a plurality of different applications; and a remote management apparatus, connected to the imaging apparatus via a network, that manages an operation condition of the imaging apparatus; wherein:

the remote management apparatus sets a termination condition for terminating each application of the imaging apparatus and sends the set termination condition to the imaging apparatus via the network; and the imaging apparatus stores the termination condition received from the remote management apparatus in a storage area in association with the corresponding application, and terminates the application that satisfies the termination condition during activation.

12. The remote management system as claimed in claim 11, wherein:

the imaging apparatus sends a notification of the termination of the application to the remote management apparatus via the network upon terminating the application.

13. The remote management system as claimed in claim 12, wherein:

the remote management apparatus further comprises a display unit that displays the notification received from the imaging apparatus.

14. The remote management system as claimed in claim 11, wherein:

the remote management apparatus generates first update information for changing the termination condition and sends said first update information to the imaging apparatus; and the imaging apparatus receives the first update information, and updates the termination condition stored in the storage area based on the first update information.

15. The remote management system as claimed in claim 14, wherein:

the imaging apparatus sends a notification of a first updating result of the table to the remote management apparatus via the network when the termination condition stored in the storage area is updated.

16. The remote management system as claimed in claim 15, wherein:

the remote management apparatus further comprises a display unit that displays the notification received from the imaging apparatus.

17. The remote management system as claimed in claim 11, wherein:

the remote management apparatus has an expiration time management unit that manages an expiration time of each application in the imaging apparatus, generates a termination instruction command for the application that has reached the expiration time, and sends said termination instruction command to the imaging apparatus; and the imaging apparatus terminates the application based on the termination instruction command received from the remote management apparatus.

18. The remote management system as claimed in claim 11, wherein:

the remote management apparatus sets an initial state that indicates whether or not each application of the imaging apparatus is to be activated upon power-on of the imaging apparatus, and sends said initial state to the imaging apparatus; and the imaging apparatus stores the received initial state in the storage area in association with the corresponding application and activates the application that needs to be activated by referring to the stored initial state.

19. The remote management system as claimed in claim 18, wherein:

the remote management apparatus generates update information for changing the initial state, and sends said update information to the imaging apparatus; and the imaging apparatus updates the initial state that is stored in the storage area based on the update information received from the remote management apparatus.

20. The remote management system as claimed in claim 19, wherein:

the imaging apparatus sends a notification of an updating result of the table to the remote management apparatus via the network when the initial state stored in the storage area is updated.

21. The remote management system as claimed in claim 20, wherein:

the remote management apparatus further comprises a display unit that displays the notification received from the imaging apparatus.

22. The remote management system as claimed in claim 11, wherein:

the remote management apparatus generates an activation instruction command for activating the application upon power-on of the imaging apparatus and sends said activation instruction command to the imaging apparatus; and the imaging apparatus activates the corresponding application based on the activation instruction command received from the remote management apparatus.

* * * * *